US005310065A

United States Patent [19]

Wark

[11] Patent Number: 5,310,065

[45] Date of Patent: May 10, 1994

[54] SELF-CLEANING COAL BYPASS AND DEBRIS SEPARATION GRID ASSEMBLY WITH ROTARY CLEARING MECHANISM

[75] Inventor: Rickey E. Wark, Lake Angelus, Mich.

[73] Assignee: Sure Alloy Steel Corporation, Warren, Mich.

[21] Appl. No.: 861,274

[22] Filed: Mar. 31, 1992

Related U.S. Application Data

[63] Continuation-in-part of Ser. No. 560,076, Jul. 30, 1990, Pat. No. 5,133,852.

[51] Int. Cl.[5] ..... B07C 5/06

[52] U.S. Cl. ..... 209/627; 209/354; 209/358; 209/389

[58] Field of Search ..... 209/311, 313, 314, 353, 209/354, 358, 324, 379, 384, 389, 390, 393, 283, 675, 678, 625, 627

[56] References Cited

U.S. PATENT DOCUMENTS

| | | | |
|---|---|---|---|
| Re. 11,634 | 10/1897 | Williams . | |
| 1,109,302 | 9/1914 | Rice | 209/324 |
| 1,485,872 | 3/1924 | Nelson . | |
| 1,529,370 | 3/1925 | Nelson | 209/283 |
| 1,567,075 | 12/1925 | Pates . | |
| 2,183,583 | 12/1939 | Patterson | 83/6 |
| 2,600,508 | 6/1952 | Lehman et al. | 209/354 |
| 3,074,655 | 1/1963 | Gontier | 241/88 |
| 3,154,622 | 10/1964 | Reinfeld | 266/28 |
| 4,221,341 | 9/1980 | Schymura et al. | 241/67 |
| 4,592,516 | 6/1986 | Tschantz | 241/76 |
| 4,709,197 | 11/1987 | Goldhammer | 318/480 |
| 4,721,257 | 1/1988 | Williams | 241/36 |
| 4,793,561 | 12/1988 | Burda | 241/36 |
| 4,966,689 | 10/1990 | Wark et al. | 209/384 |

FOREIGN PATENT DOCUMENTS

| | | | |
|---|---|---|---|
| 60043 | 8/1942 | Denmark | 209/358 |
| 430901 | 6/1974 | U.S.S.R. | 209/358 |
| 11346 | of 1905 | United Kingdom | 209/313 |
| 687860 | 2/1953 | United Kingdom . | |

*Primary Examiner*—David H. Bollinger
*Attorney, Agent, or Firm*—Krass & Young

[57] ABSTRACT

A self-cleaning coal bypass and debris separation grid assembly has a sizing/segregating grid for particulate material such as coal, and a debris bypass grid downstream to bypass the coal to a coal crusher and separate any debris which might damage the crusher. Clearing mechanisms are provided for both the sizing/segregating grid and the debris separating grid. The clearing mechanism for the debris separating grid is preferably a rotating clearing comb having arcuate fingers yieldably mounted to a rotating axle shaft. The arcuate fingers are preferably adjustably tensioned to the axle shaft.

25 Claims, 5 Drawing Sheets

14
36
26
34
28
66
54
52
64
20
21

66
80
78
70
67
84
72
82
68

SELF-CLEANING COAL BYPASS AND DEBRIS SEPARATION GRID ASSEMBLY WITH ROTARY CLEARING MECHANISM

Prior Application

This is a continuation-in-part application of my co-pending U.S. Ser. No. 560,076, filed Jul. 30, 1990, now U.S. Pat. No. 5,133,852.

FIELD OF THE INVENTION

This invention relates to sizing apparatus of the type used, for example, to segregate a stream of coal as between relatively large and small particles en route to a crusher. More particularly, the invention provides self-cleaning coal-segregation and debris-separation grids, at least one of which utilizes one or more continuously rotating clearing combs for both removing coal from between the bars of the grids and/or sweeping debris from the surface thereof.

BACKGROUND OF THE INVENTION

The boilers of coal-fired steam generators in electric utility plants are typically used in conjunction with crushers to reduce raw coal to chunks or particles of less than a certain size prior to pulverization and introduction to the boiler combustion chamber. To prolong the life of the crusher components, the coal is first passed through a sizing/segregating grid made up of parallel bars disposed in the vertical path of a coal chute and spaced apart to pass smaller chunks such that they may be diverted around, rather than through, the crusher. In a given coal stream, this segregation may result in between 40% and 80% of the coal bypassing the crusher.

The grid in the aforementioned apparatus is typically made up of steel bars welded into a grid and disposed in a vertical chute at an angle such that smaller chunks of material pass through while larger chunks of material are caught by the grid and directed into the crusher. In such an operation, some coal chunks are inevitably of such size as to collect on and between the grid bars. Ultimately, such collected materials jam or plug the grid in varying degrees and degrade the efficiency of the segregating operation. To ensure proper operation, these collected materials must be removed from the grid.

For this purpose it is known from my U.S. Pat. No. 4,966,689 to use a clearing comb made up of rigid steel fingers normally located in a home position below and behind the grid where it is essentially out of the path of travel of the material which passes through the grid. The comb is periodically actuated by an air cylinder or the like to cause the fingers to lift as a unit and to simultaneously pass upwardly through and between the grid bars to lift and clear the jammed materials from the grid. The air cylinder is then deactivated and the comb drops back to the home position.

While the comb fingers pass between the grid bars they effectively block the grid and divert all material into the crusher.

In my co-pending application Ser. No. 560,076, filed Jul. 30, 1990, I disclose a sizing apparatus for rough size-segregation of coal and other particulate material wherein the sizing/segregation grid is continuously cleared of material which jams between or bridges the bars of the grid. In general, this is achieved through the use of a rotating comb comprising a plurality of parallel fingers which rotate through and between the bars of the grid about an axis which passes essentially through and at right angles to the grid bars.

In an illustrative embodiment further disclosed therein, a sizing grid is equipped with two rotating combs, the fingers of respective combs rotating about spaced parallel axes and driven by a single motor. The fingers of each comb are progressively staggered in angular position and the two combs are arranged relative one another so that the swept volumes thereof overlap. Comb fingers are angularly arranged to avoid mechanical interference during rotation. In a preferred form, the comb fingers are staggered in angular relationship to one another or arranged in staggered groups so that the grid is never completely blocked over its entire area. In this fashion, the crusher is uniformly loaded at all times. In fact, the comb fingers may be arranged on two or more parallel, spaced axles which are synchronously driven. Moreover, means are provided for reversing the direction of rotation of the combs. In the illustrative embodiment, this is achieved on a demand basis by monitoring comb drive motor current and activating a reversing switch whenever an increase in motor current indicates a stalled or incipient stall condition in the motor.

Coal fed into the sizer-segregator and subsequently to the crusher typically contains a substantial amount of debris left over from the mining and initial processing. The debris can include relatively large pieces of wood, metal or rock, all of which can seriously damage the crusher and make inoperative various safety features in the crusher. It is known to provide a magnetic separator upstream of the sizer-segregator to remove ferromagnetic metal from the coal fed into the system. Magnetic separators, of course, fail to separate non-ferromagnetic junk such as wood, non-magnetic metal and rock, and therefore are an inadequate solution to the problem of keeping damaging debris out of the crusher.

The typical coal sizing/segregating grid as described above performs only a coal separating function; i.e., it permits small pieces of coal to bypass the crusher while directing larger chunks of coal directly into the crusher. Unfortunately, any large debris missed by the magnetic separator will also be directed straight into the crusher by the grid, creating the potential for expensive and time-wasting damage to the crusher.

SUMMARY OF THE INVENTION

The subject invention provides a debris-separating grid downstream of the size-segregation grid in the path of the large chunks of coal separated by the first grid and diverted into the crusher. In general, the second debrisseparating grid is designed to pass substantially all of the coal into the crusher while deflecting debris to bypass the crusher.

The debris bypass grid is presented to the stream of coal diverted toward the crusher at an angle shallower than that of the sizing/segregating grid upstream; i.e., the secondary bypass grid is closer to the horizontal with respect to the coal stream than is the primary sizing/ segregating grid. The spacing of the bars in the secondary bypass grid is substantially greater than that in the primary sizing/segregating grid, preferably slightly larger than the diameter of the largest chunks of coal anticipated to be directed into the crusher. This insures a free flow of coal into the crusher without unnecessary loss due to deflection by the grid or jamming between the bars. The shallower angle of the secondary bypass grid further insures that the coal passes therethrough without being deflected by the grid.

Accordingly, debris deflected by the primary sizing-/segregating grid along with the large chunks of coal is separated out of the coal stream by the secondary bypass grid to protect the crusher, while the large chunks of coal fall substantially unimpeded therethrough to be crushed.

The shallow angle of the secondary bypass grid necessary to insure the flow of substantially all the coal into the crusher, also tends to trap or hold the separated debris on its surface. That is, the debris tends to sit on the secondary grid rather than being deflected therefrom. Also, it is inevitable that, despite the wide spacing of the secondary grid bars, the occasional oversized, piece of coal will become lodged between the bars. The subject invention accordingly also provides an improved rotary clearing mechanism to continuously sweep debris from the surface of the secondary bypass grid. A secondary function of the improved rotary clearing apparatus is to clear the occasional piece of coal wedged between the bars of the secondary grid. In this respect, it is also suitable for providing a clearing function as performed by my previous rotary clearing comb in U.S. patent application Ser. No. 560,076 with respect to the primary sizing/segregating grid.

In an illustrative embodiment further disclosed herein, a primary sizing/segregating grid is provided alternately with the rigid clearing comb of my U.S. Pat. No. 4,966,689, or one or more rotating clearing combs according to my U.S. patent application Ser. No. 560,076, and is supplemented with a secondary debris-separating grid according to the present invention intermediate the primary sizing/segregating grid and the coal crusher. The secondary bypass grid is provided with an improved rotating clearing comb according to the present invention, comprising a plurality of arcuate tines or fingers progressively staggered in angular position along the length of the comb shaft to provide a continuous sweeping function and ensure that the grid is never completely blocked over its entire area. The curvature of the fingers is such that their tips are swept back away from the direction of rotation of the comb. The swept-back arcuate nature of the fingers insures that they do not trap any debris against the relatively shallow bypass grid and bind up the system.

In a further illustrative embodiment, the arcuate fingers are yieldably mounted with respect to the comb shaft such that they yield with respect to the shaft when they encounter a particularly heavy piece of debris or other obstruction. This yielding movement is preferably slight, enough to reduce stress on the comb while still applying sufficient clearing force to the debris. In one embodiment, the arcuate fingers are spring-mounted to hubs fastened to the comb shaft. In another embodiment, the fingers are adjustable in their yielding motion relative to the hubs and shaft by way of an adjustable-tension spring.

In a particular embodiment of the invention, each arcuate finger is spring-mounted to a semi-circular hub segment adapted to be rigidly fastened to the comb shaft. The shaft is divided up into a plurality of two-fingered segments comprising two of the semi-circular hubs fastened to the shaft 180° opposite each other. Adjacent hub/finger segments along the shaft are offset 90° to achieve a staggered comb effect. Each of the semi-circular hubs is positioned on and removed from the comb shaft in a direction perpendicular to the axis of the shaft, permitting the removal/replacement of individual hubs without the need for removing any other hub sections along the shaft. This feature greatly aids in the replacement of damaged hub sections.

While the arcuate-finger clearing comb of the present invention is primarily illustrated in connection with the secondary bypass grid to perform a sweeping function, it will be understood that it is also capable of performing a clearing function to remove coal wedged between the bars of the bypass grid. It accordingly can be used in connection with the primary sizing/segregating grid in the manner of my straight-fingered rotary clearing comb in U.S. patent application Ser. No. 560,076.

While the invention is illustrated in connection with a crusher apparatus for coal, it may be used to provide a primary size-segregation operation for any randomly sized particulate material including aggregate. The terms "particulate" and "particle", as used herein, are not intended to denote a size range or to suggest extremely fine material such as sand or powder. Rather, such terms are used in a generic sense to suggest any divided solid material which is presented in a varying and typically random size distribution or spread.

DETAILED DESCRIPTION OF THE SPECIFIC/ILLUSTRATIVE EMBODIMENT

Figure 2:
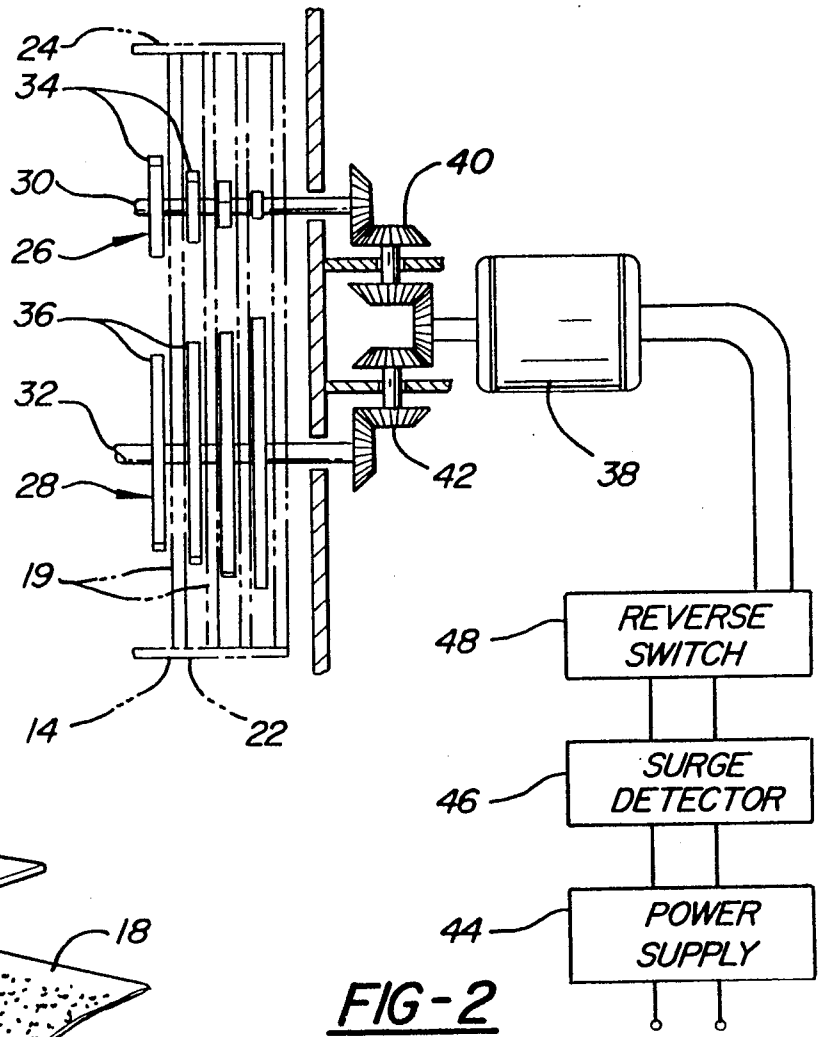
FIG. 2 is a schematic diagram of the double comb drive system with automatic reverse.
Figure 1:
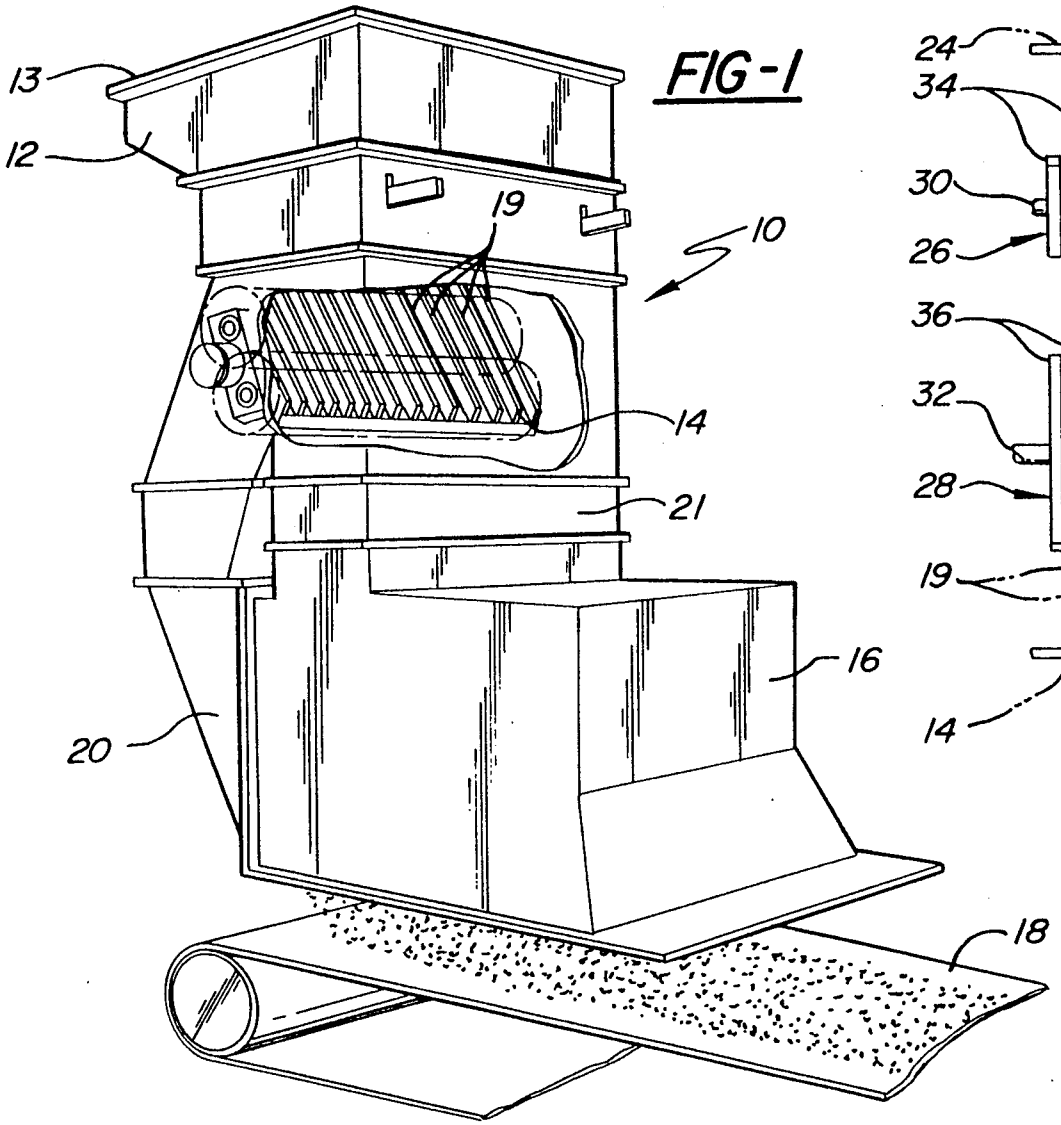
FIG. 1 is a perspective view of a coal crusher with delivery chute and outlet conveyor and with a portion of the chute broken away to indicate the location and environment of a size-segregation grid equipped in accordance with the present invention.

Referring to FIGS. 1 through 4, a coal segregator and crushing apparatus 10 comprises a chute-like input hopper 12 into which divided material such as coal is introduced by way of an appropriate feed system such as a conveyor or trough. In a preferred embodiment, the input hopper 12 is vertically oriented so that the particulate material passes through the hopper 12 along a generally vertical path. The coal falls by gravity through an inlet 13 of input hopper 12 toward a sizing grid 14 which is angularly positioned between the input hopper 12 and a pair of outlet chutes 20 and 21. The segregation grid 14 operates to divert the larger particles or chunks through the outlet chute 21 to a conventional crusher 16. The crushed particles of coal are deposited onto a conveyor 18 which carries the material to a coal pulverizer which further reduces particles to a size suitable for introduction to the combustion chamber of a boiler. Material which is small enough to fall through the spaced parallel bars 19 of the segregation grid 14 goes through the outlet chute 20 which bypasses the crusher 16 and directly conveys these finer materials onto the conveyer belt 18. In a given load of coal, some 40% to 80% of the materials may pass through the grid 14 into the outlet chute 20 and the diversion of these materials substantially reduces wear on the crusher components, effectively increases crusher throughput and reduces power consumption. In addition, such diversion reduces the accumulation of coal fines in the crusher area.

The sizing/segregation grid 14 is made up of parallel essentially blunt tapered bars 19 made of steel and having a rectangular cross section. Bars 19 are welded together in a rigid grid by means of end plates 22 and 24 and the grid is disposed in the input chute of the apparatus 10 at an angle of about 45 degrees from the horizontal such that the majority of the material which is too large to pass cleanly through grid bars 19 simply bounces off or slides along the top of the grid bars 19 into the outlet chute 21 which leads into the crusher 16. The spacing between bars 19 determines the size of the material which is deemed appropriate for the pulverizer and, hence, which needs no size reduction by crushing at this point.

Figure 3:
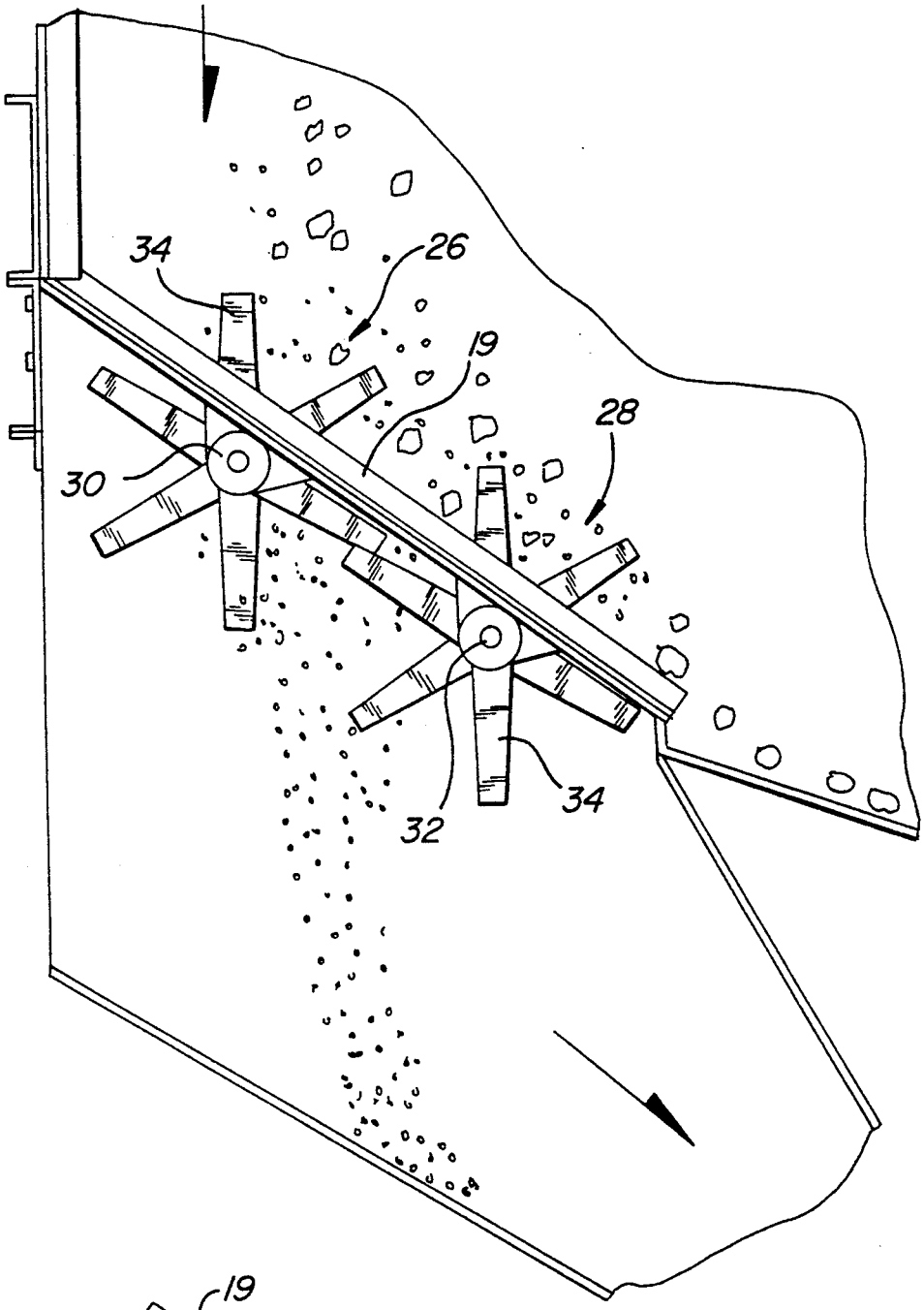
FIG. 3 is a side view of the size-segregation grid of FIG. 1 showing the overlapping relationship of the two clearing combs.

As best shown in FIGS. 2 and 3, the sizing/ segregating grid 14 is provided with clearing combs 26 and 28 having spaced parallel axes of rotation defined by shafts 30 and 32 passing essentially through and at right angles to the longitudinal axes of the spaced parallel grid bars 19; i.e., for simplicity of construction, the axle shafts 30 and 32 are located just below the plane of the bars 19. Comb 26 comprises a plurality of spaced parallel radial fingers 34 which are disposed along the shaft 30 so as to lie between the parallel bars 19 of the grid 14 such that rotation of shaft 30 causes the fingers 34 to rotate or sweep through a cylindrical volume which covers approximately half of the effective area of the grid 14.

Figure 4:
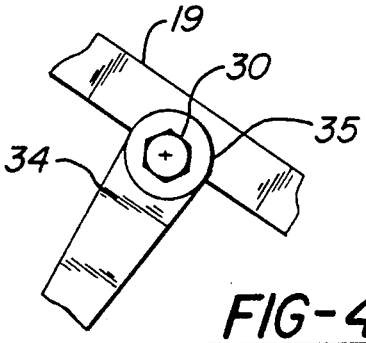
FIG. 4 shows a detail of the installation of a clearing comb finger.

The fingers 34 are made of steel, are preferably straight, tapered toward the ends. The fingers 34, as shown in FIG. 4, extend radially from shaft 30 and are mechanically locked to the shaft 30 to rotate therewith. In the illustrated embodiment, the shaft 30 is hexagon shaped and the fingers have hexagon-shaped apertures through which the shaft 30 slides for installation. Spacers (not shown) locate the fingers between the grid bars 19. In addition, the fingers 34 are mounted on the shaft in uniformly and progressively staggered angular positions; i.e., in the case of 6 fingers, the angle between any two adjacent fingers is on the order of 60 degrees. This figure is given for illustration only, as a typical grid has more than six sizing bars. Although not shown, the fingers may also be arranged in groups of, for example, three fingers with the same angular relationship to the shaft 30. The adjacent groups would, in this example, be angularly shifted. This grouping simplifies installation, especially where the number of fingers exceeds the number of facets on shaft 30.

Comb 28 is substantially identical to comb 26, again being made up of rigid steel fingers 36 spaced along the shaft 32 so as to rotate through and between adjacent parallel bars 19 of the grid 14. Fingers 36 are also staggered in angular position and define or sweep through a volume which overlaps the swept volume of comb 26. Accordingly, the fingers 36 are arranged in angular position relative to the fingers 34 so that no mechanical interference occurs during rotation.

As best shown in FIG. 3, the axes of rotation defined by the shafts 30 and 32 are sufficiently close to the plane of the bars 19 that the fingers pass continuously through and between the bars 19 to clear the bars of collected intermediate sized materials. Staggered fingers are more desirable where only a single comb is used, thereby to avoid a condition wherein the entire grid is blocked for a brief instant each time the comb fingers pass through the bars 19. Where multiple combs are used, staggering is less important then with an individual comb. But it is still desirable to angularly stagger the combs from one another. As shown in FIG. 4, the fingers 34 have circular steel hubs 35 mounted on shaft 30 for rotation therewith. Hubs 35 extend up between the bars 19 above the axis of rotation to prevent small pieces of coal from jamming the hub as it rotates.

Direction of rotation of combs 26 and 28 may be selected at the operator's direction. Rotating with the undiverted flow accelerates the particles whereas rotating against the flow throws particles back onto the grid where a greater number may fall through.

Shafts 30 and 32 are continuously rotated by a DC drive motor 38 which is connected to the shafts 30 and 32 through bevel gear systems 40 and 42. The gear systems 40 and 42 are conventional and are sufficiently diagrammatically illustrated in FIG. 2 as to obviate the need for detailed description. Moreover, it is to be understood that the bevel gear drive systems 40 and 42 are merely representative of a variety of drive systems which may be employed; for example, a gear and sprocket drive can be used. The bevel gear systems 40 and 42 are such as to rotate the shafts 30 and 32 in the same angular direction.

DC drive motor 38 is connected to a conventional power supply 44 which is connected to the locally available AC line voltage. Power supply 44 is connected through a motor current surge detector 46 and a reversing switch 48 to the motor 38. The operation of the components 46 and 48 is such that a current amplitude change triggers a surge detector 46 to produce a signal which toggles the reversing switch 48 to reverse the polarity of either field or armature current applied to the motor 38 thereby to reverse the direction of detector thereof. Surge detector preferably employs both a maximum current amplitude detector and a rate-of-current-amplitude-change detector, such as a differentiator circuit.

Figure 5:
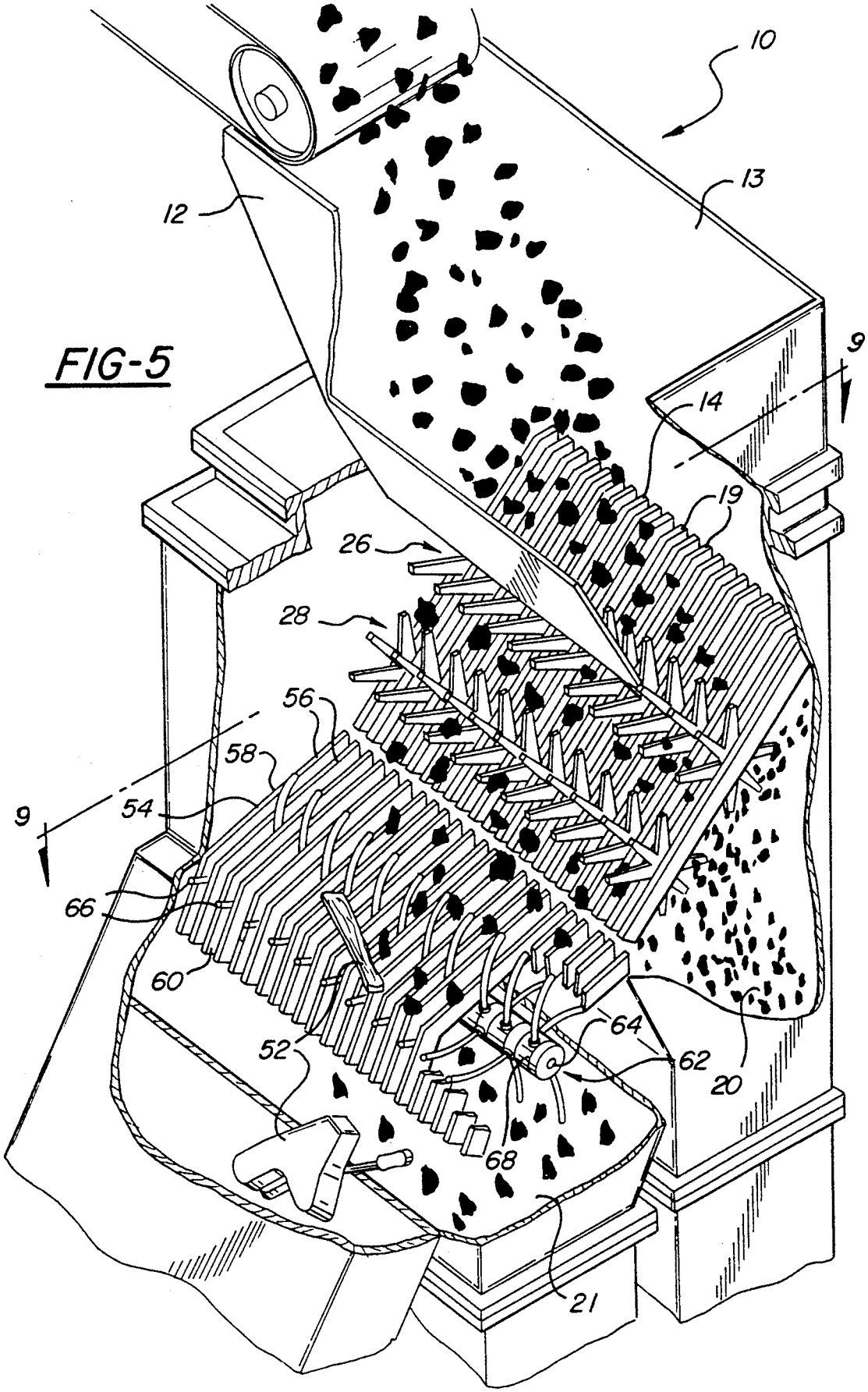
FIG. 5 is a perspective view of a coal crusher with delivery chute and outlet conveyor feeding coal into the coal-and debris-separating system of the present invention employing straight-fingered and arcuate-fingered rotary combs.

An improved version of the system disclosed above is shown in FIGS. 5-9. In order to remove ferromagnetic debris from the coal fed by the conveyor into input hopper 12, a conventional magnetic separator (not shown) is mounted adjacent the coal conveyor upstream of the input hopper. Non-ferromagnetic debris 52, for example pieces of wood and non-magnetic metals, is missed by the magnetic separator and is fed into the input hopper 12 where it is generally deflected by sizing/segregating grid 14 along with the larger pieces of coal. To prevent the introduction of debris 52 into the crusher 16, a secondary debris separation and bypass grid 54 is provided at the downstream end of grid 14. Secondary bypass grid 54 is made up of parallel tapered bars 56 similar to those in grid 14, but are spaced farther apart than bars 19, as best shown in FIG. 5. For example, if the spacing between bars 19 and coal separating grid 14 are spaced apart approximately 1½ inches, spacing of bars 56 and secondary bypass grid 54 is typically on the order of 4 to 6 inches, depending of course upon the size of the coal particles being fed into the system. An important consideration is that the spacing of bars 54 is sufficient to permit the free passage therethrough of the largest anticipated pieces of coal deflected by grid 14.

Figure 6:
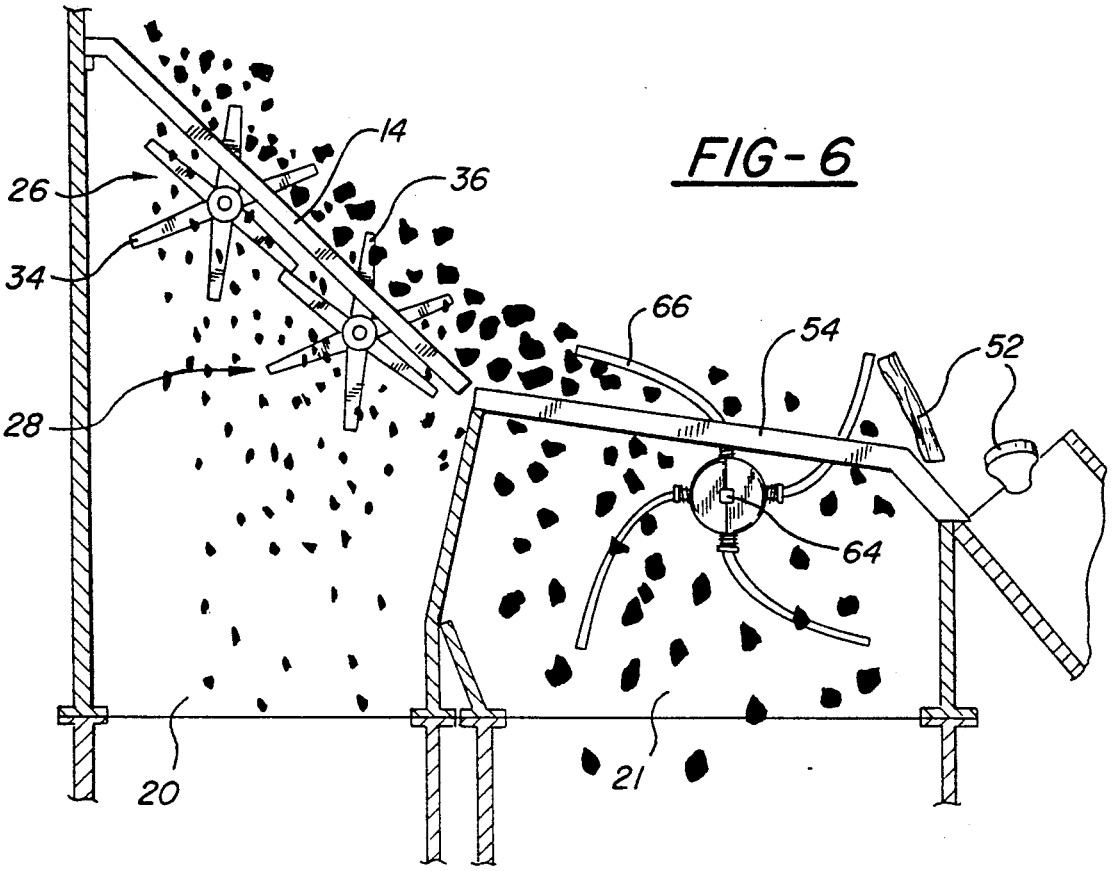
FIG. 6 is a side view of the system shown in FIG. 5.

Referring now to FIG. 6, it can be seen that secondary bypass grid 54 is disposed at a shallower angle with respect to the vertical coal flow than primary sizing/segregating grid 14. For example, where grid 14 is positioned at an approximately 45° angle with respect to the vertical flow of coal through input hopper 12, secondary bypass grid 54 will typically be angled at approximately 75° to 90°. Bars 56 of bypass grid 54 comprise upper and lower ramp portions 58, 60, with upper ramp 58 positioned at the above-described shallower angle, and lower ramp 60 bent downwardly at a steeper angle for a purpose hereinafter described.

It will be understood that although two separate grids are set forth in the illustrated embodiment, it is within the scope of the invention to have a single grid comprising a sizing/segregating portion between input hopper 12 and outlet chute 20, and a debris bypass portion between the sizing/segregating portion and outlet chute 21.

Secondary bypass grid 54 is provided with a debris-clearing comb 62 having an axis of rotation defined by shaft 64 passing essentially through and at right angles to the longitudinal axis of bars 56 in grid 54; i.e., for simplicity of construction, shaft 64 is located just below the plane of grid 54. Comb 62 comprises a plurality of spaced arcuate fingers 66 disposed along shaft 64 so as to lie between the parallel bars 56 of grid 54 such that rotation of shaft 64 causes fingers 66 to rotate or sweep through a cylindrical volume which covers approximately half of the effective area of grid 54.

Figure 7:
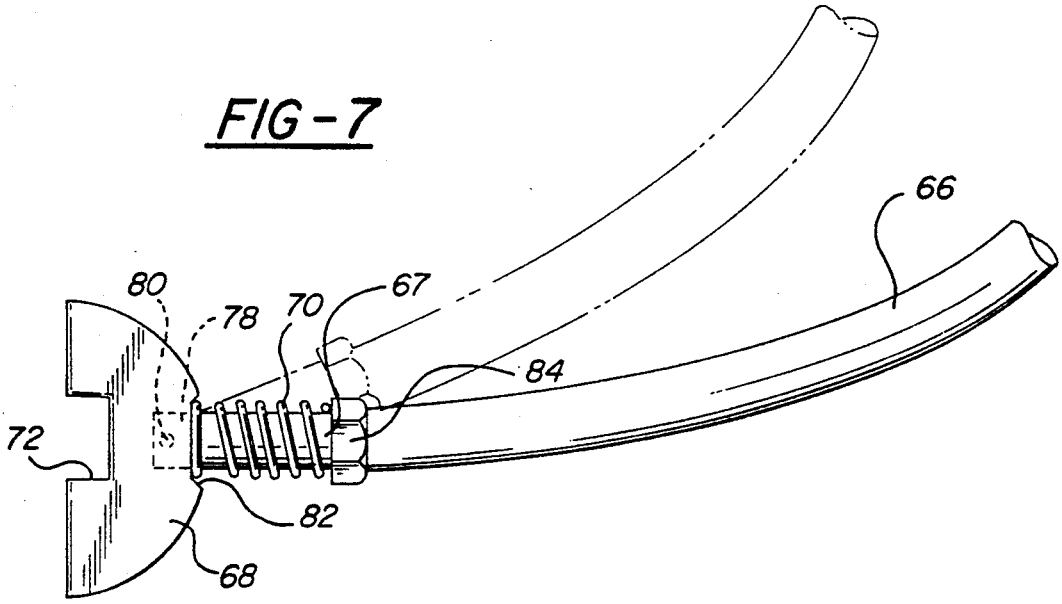
FIG. 7 is a side section view of one finger/hub unit of the arcuate clearing comb shown in FIG. 6.
Figure 8:
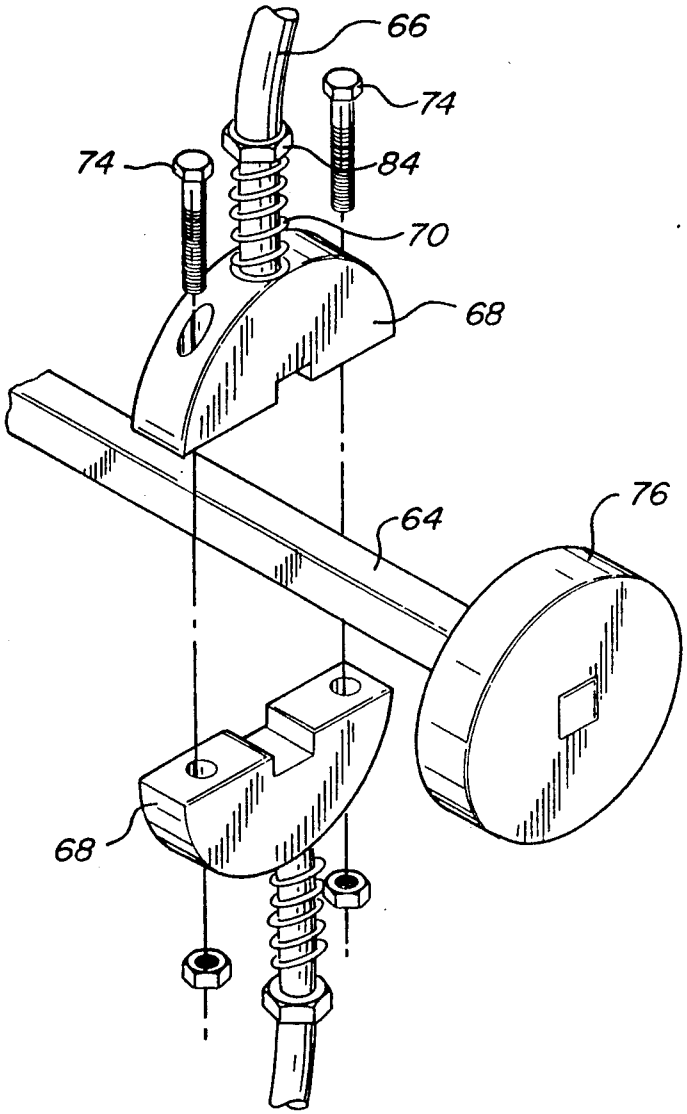
FIG. 8 is an exploded view of the shaft and a plurality of hub/finger units of the arcuate clearing comb of the present invention.

As best shown in FIGS. 7 and 8, fingers 66 comprise rigid, arcuate members preferably made from steel, with the curve or arc of the fingers opposite to the direction of rotation of comb 62. Fingers 66 as shown in FIG. 3 are fastened to shaft 64 via hubs 68 to rotate therewith. In the illustrated embodiment, shaft 64 is square in cross-section and semi-circular hubs 68 have rectangular cutout portions 72 as shown in FIG. 3 which mate with shaft 64. The dimensions of cutout portions 72 are approximately half that of the square shaft itself, such that two hubs may be mounted opposite each other on the shaft to form a unitary, circular two-fingered hub segment. The semi-circular hubs 68 are fastened to each other with bolts 74, such that each circular hub segment is radially locked relative to the shaft. The hubs are secured lengthwise along the shaft by end caps 76 or similar structure (e.g., bolts) and by adjacent finger/hub segments. As shown in the drawings, each hub segment is preferably offset ninety degrees from the adjacent segment, but it will be apparent to those skilled in the art that other angular patterns can be used.

Referring now to FIG. 7, each arcuate finger 66 is attached to a semi-circular hub 68 by pivotal connection of end tab 78 of the finger to a pivot pin or bolt 80 extending transversely of an internal slot opening to a pivot recess 82 formed centrally in the outer periphery of the hub. Arcuate finger 66 is biased to a neutral, upright position by a stiff spring 70 fixed at one end by welding or the like to pivot recess 82. The tension of spring 70 is manually adjustable by either tightening or loosening tension nut 84 along a threaded portion 67 of finger 66. Arcuate finger 66 is accordingly pivotally yieldable with respect to semi-circular hub 68 in an arc defined by pivot recess 82, resisted to varying degree by adjustable tension spring 70.

Referring now to FIG. 8, semi-circular hubs 68 are removed from and mounted on shaft 64 radially of the shaft axis, rather than axially along its length. This enables an operator to selectively replace the finger/hub segments without being required to remove or disturb the placement of the other finger/hub segments along the shaft. This feature greatly reduces down time for replacement of worn or damaged parts.

Rotation of shaft 64 and debris-clearing comb 62 is in one direction only; i.e., opposite the direction of curvature of swept back, arcuate fingers 66. This ensures that fingers 66 of comb 62 present essentially tangential frictional clearing surfaces with respect to debris 52 sitting on top of grid 54. The arcuate fingers provide sufficient force to clear the debris from the grid, but will not trap debris against the grid and bind the rotor 62. This arcuate, tangential contact between fingers 66 and the debris to be cleared also reduces the strain on each individual finger. Accordingly, while shaft 64 may be rotated by a drive system (not shown) essentially the same as the drive system for clearing comb 26 (DC motor 38, beveled gears 40 and 42, power supply 44), it does not require the motor current surge detector 46 and reversing switch 48 as in the straight-fingered embodiment. The yielding pivot connection between fingers 66 and shaft 64 also serves to reduce the stress on the fingers when they encounter a particularly heavy piece of debris, or should they somehow strike one of the bars 56 of grid 54. At the same time, fingers 66 are held strongly enough by adjustable tension springs 70 to adequately clear debris and even remove large pieces of coal wedged between bars 56.

Figure 9:
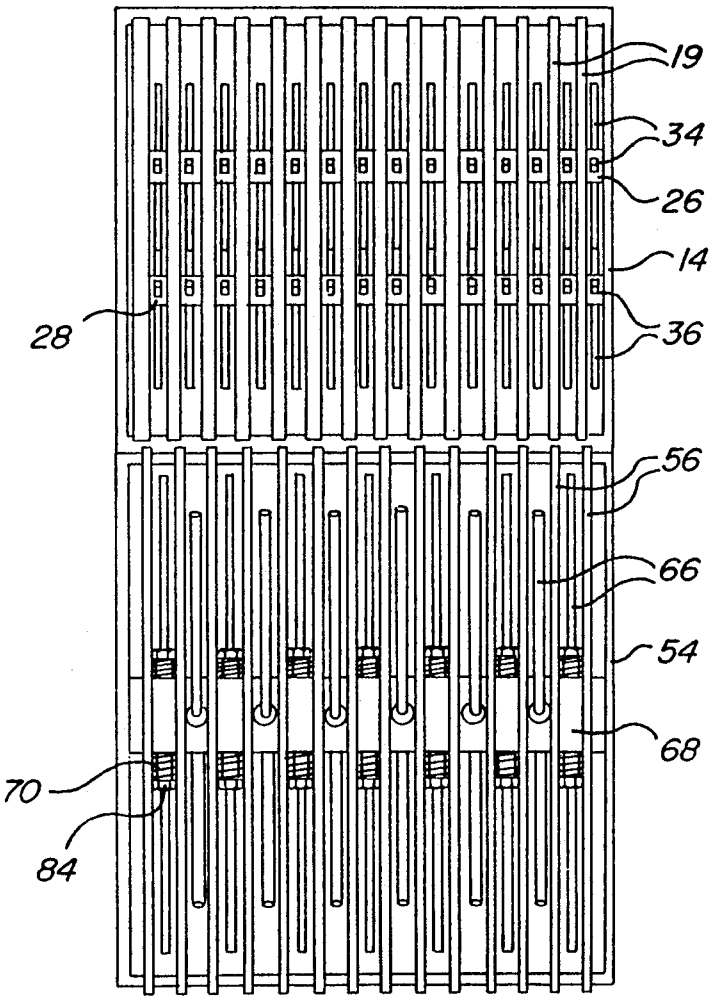
FIG. 9 is a plan view of the coal-and debris-separating grid system of FIG. 5.

Referring now to FIG. 9, the difference in spacing of bars 19 of grid 14 and bars 56 of grid 54 can be clearly seen. The spacing between grid bars 56 not only must be great enough to freely pass the largest anticipated pieces of coal deflected by grid 14, but must further be wide enough to accomplish this while arcuate fingers 66 are positioned therebetween. In general, the spacing between grid bars 56 can be set by the following formula: the spacing required to pass the largest anticipated pieces of coal, plus the width or diameter of arcuate fingers 66, plus a little extra for insurance. Accordingly, the width or diameter of arcuate fingers 66 is substantially less than the width of the spacing between bars 56.

OPERATION OF THE ILLUSTRATED EMBODIMENT

Material sized by the grid 14 normally either passes through or is deflected along the top surface of the bars 19. However, as indicated above, intermediate chunks or particles frequently collect on and/or jam between the bars 19 and are cleared therefrom by the fingers 34 and 36 of the combs 26 and 28, respectively. If, however, material collects or jams in sufficient quantity or with severity, the fingers 34 and 36 may stall or jam between the bars 19. In this event, the motor current tends to spike upwardly, a condition which is detected by way of the differentiator circuit in the surge detector 46. The signal from the surge detector 46 is applied to the reversing switch 48, a switch similar to that used in garage door operators for alternating the direction of garage door travel, to reverse the polarity of the power supply to the motor 38 and reverse the direction of motor rotation. This effectively instantaneous reversal in the direction of the output shaft of motor 38 also reverses the direction of rotation of the shafts 30 and 32 and clears the jammed material from the bars.

Although the invention has been described with reference to the system comprising two spaced parallel and overlapping clearing combs, single combs and multiple combs greater than two in number can also be used. While the stall detector and reversing switch 46 and 48, respectively, are preferred, periodic reversals of the comb's direction of rotation may also be activated on a periodic or timed basis. Moreover, the reversing function may be eliminated entirely in favor of continuous, unidirectional rotation, if desired. In another form, hydraulic drive motors may be substituted for the electric drive motors and surge detection may be accomplished by monitoring hydraulic line pressure to the motors. Other variations and modifications in the illustrated system will occur-to those skilled in the art.

The large pieces of coal separated and deflected by grid 14, and any debris 52 deflected therewith, hit grid 54, whereupon the coal drops through the spaces between bars 56 directly into the crusher while large debris 52 sits on top of grid 54. Arcuate fingers 66 of debris-clearing comb 62 continuously sweep through the spaces in the grid to clear debris from its surface and to clear the grid for incoming coal. Fingers 66 also clear coal wedged between bars 56.

Should comb 62 encounter a particularly heavy piece of debris or accidentally contact one of bars 56, or encounter a tightly wedged piece of coal between the bars, the arcuate fingers 66 will pivotally yield with respect to its hub 68 and shaft 64 should the obstruction present resistance strong enough to otherwise unduly stress comb 62. The continuous, successive sweeping effect of the fingers as they are rotated through bars 56 will eventually loosen the obstruction and clear it from grid 54.

Should fingers 66 or related hub segments become worn or damaged, it is a simple matter for the operator to stop rotation of comb 62 and remove an individual segment for replacement without having to remove or disturb the position of any other finger/hub segment on shaft 64.

While the illustrated embodiment is shown utilizing the rotary clearing combs 26, 28 of my co-pending application U.S. Ser. No. 560,076, it will of course be understood to those skilled in the art that the rectilinear comb as disclosed in my U.S. Pat. No. 4,966,689 could be used in grid 14. It will also of course be understood that the arcuate-fingered rotary debris-clearing comb 62 of the present invention can be used not only to clear secondary bypass grid 54 as illustrated, but also to provide coal-clearing for grid 14 without the need for a surge detector and reversing motor.

Other variations and modifications of the illustrated invention will be apparent to those skilled in the art as being within the scope of the appended claims.

I claim:

1. In a material segregating apparatus for particulate material such as coal:

an inlet structure disposed to accept particulate material, a first outlet and a second outlet;

a segregating grid interposed between the inlet structure and the first and second outlets comprising a plurality of parallel bars spaced apart to pass material less than a predetermined size between the bars and toward the first outlet and to divert material greater than the predetermined size toward the second outlet;

first grid-clearing means for the segregating grid;

a debris-separating grid interposed between the segregating grid and the second outlet comprising a plurality of parallel bars spaced apart to pass the particulate material diverted by the segregating grid and to divert debris greater than the size of the particulate material away from the second outlet; and a debris-clearing comb comprising a plurality of parallel fingers mounted radially on an axle shaft and disposed between the bars, and means for continuously rotating the debris-clearing comb about an axis below the bars of the debris-separating grid such that the fingers of the debris-clearing comb pass between and through the bars as they rotate to sweep debris from the surface.

2. Apparatus as defined in claim 1, wherein the segregating grid is disposed at a first, steeper angle relative to the horizontal and the debris-separating grid is disposed at a second, shallower angle.

3. Apparatus as defined in claim 1, wherein the fingers of the debris-clearing comb are arcuate, swept back away from the direction of rotation of the comb.

4. Apparatus as defined in claim 3, wherein the fingers of the debris-clearing comb are rigid, the rigid fingers pivotally yieldingly mounted to the shaft.

5. Apparatus as defined in claim 1, wherein at least two of the debris-clearing comb fingers, when at rest, are disposed in different angular positions about the axis of rotation.

6. An apparatus for segregating particulate material by size comprising:

an input chute having a vertical path portion for particulate material;

a first grid connected to receive material from the input chute and to pass material of less than a predetermined size to a first chute and to divert material of at least the predetermined size to a second chute;

a first clearing comb;

the grid comprising a plurality of uniformly spaced, essentially blunt, parallel bars, the first clearing comb comprising a plurality of fingers interposed between the parallel bars and at least one axle shaft whose axis passes essentially through the parallel bars, the fingers attached to the axle shaft for rotation therewith;

means for essentially continuously slowly rotating the clearing comb so as to continuously clear said first grid; and a second grid between the first grid and the second chute at an angle to the first grid, the second rid comprising a plurality of uniformly spaced parallel bars, the spacing of which is at least great enough to pass material of the predetermined size to the second chute.

7. Apparatus as defined in claim 6, wherein the second grid is oriented at a shallower angle than the first grid.

8. Apparatus as defined in claim 7, further including a second clearing comb for the second grid.

9. A size-segregation and debris-separating device for sorting and routing a stream of particulate material, comprising:

a sizing/segregating grid at a first angle to the stream of particulate material to pass material less than a predetermined size and deflect material greater than the predetermined size;

a debris-separating grid at a second angle in the path of the material deflected by the sizing/segregating grid to pass material less than a second predetermined size and to trap material greater than the second predetermined size; and means associated with the debris-separating grid for tangentially clearing away material trapped on the grid.

10. Apparatus as defined in claim 9, where the second angle is more perpendicular to the stream of particular material than the first angle.

11. Apparatus as defined in claim 10, wherein the second angle is approximately 75° to 90° relative to the stream of particulate material.

12. Apparatus as defined in claim 10, wherein the tangential clearing means comprise a plurality of arcuate fingers disposed along an axle shaft and spaced to project between parallel bars of the debris-separating grid when rotated, the arcuate fingers curving counter to the direction of rotation of the axle shaft.

13. An apparatus for sizing/segregating particulate material and for separating debris from particulate material such as coal, comprising:

an inlet structure disposed to accept an essentially vertical flow of particulate material, a first outlet chute and a second outlet chute;

a grid assembly angularly positioned between the inlet structure and the first and second outlet chutes comprising a plurality of parallel bars spaced apart to pass material less than a predetermined size between the bars;

wherein the grid assembly comprises a sizing/ segregating portion positioned between the inlet structure and the first outlet chute at a first angle, the sizing/ segregating portion of the grid comprising a plurality of parallel bars spaced a first predetermined distance apart such that particulate material having a size less than the first predetermined distance between the parallel bars shall pass between the parallel bars of the sizing/ segregating portion into the first outlet chute and particulate material having a size greater than the first predetermined distance between the parallel bars shall be deflected toward the second chute, the grid assembly further comprising a debris-separating portion positioned between the sizing/segregating portion and the second outlet chute at a second angle, the debris-separating portion of the grid assembly comprising a plurality of parallel bars spaced a second greater predetermined distance apart such that the particulate material deflected by the sizing/segregating portion of the grid assembly passes through the bars of the debris-separating portion into the second outlet chute and debris having a size greater than the second predetermined distance between the parallel bars of the debris-separating portion shall be deflected away from the second outlet chute.

14. Apparatus as defined in claim 13, further including a first grid-clearing device for the sizing/ segregating portion of the grid assembly, and a second grid-clearing device for the debris-separating portion of the grid assembly, the second grid-clearing device comprising a plurality of fingers spaced apart and disposed along an axle shaft, the second grid-clearing device positioned proximate to the debris-separating portion of the grid assembly, and means for continuously rotating the axle shaft of the second grid-clearing device such that the fingers project between the parallel bars of the debris-separating portion of the grid assembly periodically during the rotation.

15. Apparatus as defined in claim 14, wherein the fingers of the second grid-clearing device are arcuate.

16. Apparatus as defined in claim 15, wherein the arcuate fingers of the second grid-clearing device are rigid, the rigid fingers pivotally yieldingly mounted to the axle shaft.

17. Apparatus as defined in claim 13, wherein the second angle of the debris-separating portion of the grid assembly is shallower than the angle of the sizing/segregating portion of the grid assembly.

18. A rotary comb for clearing particulate material and debris resting on and wedged between the bars of a material sizing/segregating or debris-separating grid comprising:

an axle shaft;

a plurality of radial grid-clearing/sweeping fingers spaced along and yieldingly connected to the shaft, the fingers radially removable from the shaft;

means for rotating the axle shaft;

wherein, the comb is positioned proximate the grid such that the fingers pass between the bars of the grid periodically during rotation.

19. Apparatus as defined in claim 18, wherein each of the fingers is mounted to the axle shaft by a radially removable hub.

20. Apparatus as defined in claim 19, wherein the fingers are yieldingly mounted to the hubs.

21. Apparatus as defined in claim 19, wherein two of the hubs are mounted radially opposite the other about a common portion of the axle shaft to define a hub segment, each of the hubs supporting at least one finger, such that the axle shaft is divided into a plurality of hub segments comprising two or more radially opposite fingers.

22. Apparatus as defined in claim 19, wherein the hubs have a cut-out portion to radially mate with the axle shaft, each of the hubs fastened to a radially opposite hub positioned on the axle shaft to define a hub segment rotationally locked with respect to the shaft.

23. In a material segregating apparatus for particulate material such as coal:

an inlet structure disposed to accept particulate material, a first outlet and a second outlet;

a segregating grid interposed between the inlet structure and the first and second outlets comprising a plurality of parallel bars spaced apart to pass material less than a predetermined size between the bars and toward the first outlet and to divert material greater than the predetermined size toward the second outlet;

first grid-clearing means for the segregating grid;

a debris-separating grid interposed between the segregating grid and the second outlet comprising a plurality of parallel bars spaced apart to pass the particulate material diverted by the segregating grid and to divert debris greater than the size of the particulate material away from the second outlet; and a debris-clearing comb comprising a plurality of parallel fingers mounted radially on an axle shaft and disposed between the bars, and means for continuously rotating the debris-clearing comb about an axis below the bars of the debris-separating grid such that the fingers of the debris-clearing comb pass between and through the bars as they rotate to sweep debris from the surface, wherein the fingers are radially removable from the shaft.

24. An apparatus for sizing/segregating particulate material and for separating debris from particulate material such as coal, comprising:

an inlet structure disposed to accept an essentially vertical flow of particulate material, a first outlet chute and a second outlet chute;

a grid assembly angularly positioned between the inlet structure and the first and second outlet chutes comprising a plurality of parallel bars spaced apart to pass material less than a predetermined size between the bars;

wherein the grid assembly comprises a sizing/ segregating portion positioned between the inlet structure and the first outlet chute at a first angle, the sizing/ segregating portion of the grid comprising a plurality of parallel bars spaced a first predetermined distance apart such that particulate material having a size less than the first predetermined distance between the parallel bars shall pass between the parallel bars of the sizing/ segregating portion into the first outlet chute and particulate material having a size greater than the first predetermined distance between the parallel bars shall be deflected toward the second chute, the grid assembly further comprising a debris-separating portion positioned between the sizing/segregating portion and the second outlet chute at a second angle, the debris-separating portion of the grid assembly comprising a plurality of parallel bars spaced a second greater predetermined distance apart such that the particulate material deflected by the sizing/segregating portion of the grid assembly passes through the bars of the debris-separating portion into the second outlet chute and debris having a size greater than the second predetermined distance between the parallel bars of the debris-separating portion shall be deflected away from the second outlet chute, further including a first grid-clearing device for the sizing/segregating portion of the grid assembly, and a second grid-clearing device for the debris-separating portion of the grid assembly, the second grid-clearing device comprising a plurality of fingers spaced apart and disposed along an axle shaft, the second grid-clearing device positioned proximate to the debris-separating portion of the grid assembly, and means for continuously rotating the axle shaft of the second grid-clearing device such that the fingers project between the parallel bars of the debris-separating portion of the grid assembly periodically during the rotation, wherein the fingers of the second grid-clearing device are arcuate, wherein each of the fingers of the second grid-clearing device is mounted to the axle shaft by a radially removable hub.

25. Apparatus as defined in claim 24, wherein the fingers are yieldingly mounted to the hubs, and the hubs are rigidly mounted to the axle shaft.

* * * * *

UNITED STATES PATENT AND TRADEMARK OFFICE

CERTIFICATE OF CORRECTION

PATENT NO. : 5,310,065

DATED : May 10, 1994

INVENTOR(S) : Wark

It is certified that error appears in the above-indentified patent and that said Letters Patent is hereby corrected as shown below:

Column 2, line 54, delete "debrisseparating" and insert --debris-separating--;

Column 6, line 48, delete "detector" (first occurrence) and insert --rotation--;

Column 9, line 21, delete "occur-to" and insert --occur to--;

Column 10, line 57, delete "rid" and insert --grid--.

Signed and Sealed this

Sixth Day of September, 1994

*Attest:*

*Attesting Officer*

BRUCE LEHMAN

*Commissioner of Patents and Trademarks*